United States Patent [19]

Vorves

[11] 4,369,994

[45] Jan. 25, 1983

[54] STRIKE PLATE SUPPORT

[76] Inventor: Steve P. Vorves, 6250 Lyons Rd., Garland, Tex. 75043

[21] Appl. No.: 176,669

[22] Filed: Aug. 11, 1980

[51] Int. Cl.[3] ..... E05C 21/02

[52] U.S. Cl. ..... 292/340

[58] Field of Search ..... 292/340, 346, 341.18

[56] References Cited

U.S. PATENT DOCUMENTS

| | | | |
|---|---|---|---|
| 850,840 | 4/1907 | Ledford | 292/340 X |
| 2,472,174 | 6/1949 | Schneider | 292/340 |
| 2,533,396 | 12/1950 | Payne | 292/340 |
| 3,888,530 | 6/1975 | Fabrici | 292/340 |
| 4,186,954 | 2/1980 | Detlefs | 292/DIG. 53 X |

FOREIGN PATENT DOCUMENTS

| | | | |
|---|---|---|---|
| 2613267 | 3/1976 | Fed. Rep. of Germany | 292/340 |

*Primary Examiner*—Richard E. Moore

*Attorney, Agent, or Firm*—Gerald G. Crutsinger; John F. Booth; Monty L. Ross

[57] ABSTRACT

Apparatus for securing a strike plate (40) having a deflected tang portion (46) extending outwardly from the plane of the body portion (41) of the plate (40) to a door jamb (30) including a generally L-shaped connector member (11) having a pair of generally perpendicularly extending legs, a first of said legs (12) being arranged to engage the tang (46) on the strike plate (40) when positioned parallel to the plane of the body (41) of the strike plate, a portion (15) of the second leg (14) being deflected to extend away from the plane of the body of the strike plate to position the second leg (14) in a plane spaced from the plane of the first leg (12). A rod (16) is secured to the outer extremity of the first leg (12) by a hinge pin (18) such that the rod and the second leg on the connector member lie in a common plane. Anchor nuts (20) on rod (16) and on the second leg (14) are provided for attachment of the connector to a door jamb.

5 Claims, 3 Drawing Figures

STRIKE PLATE SUPPORT

CROSS REFERENCE TO RELATED APPLICATIONS

This application relates to improvements in a strike plate support of the type disclosed in my co-pending application for design U.S. Pat. No. 21,848 filed Mar. 19, 1979 entitled "STRIKE PLATE" (now Design U.S. Pat. No. D 263,675, issued Apr. 6, 1982).

BACKGROUND OF INVENTION

A strike plate having a bolt receiving opening formed therein is generally attached by screws to a door jamb such that the latch bolt will extend into the strike plate opening when the door is closed. Strike plates have been connected to door jambs by a variety of structures in an effort to provide a strong secure structure.

Connection of a strike plate to a wooden door jamb by screws generally does not provide sufficient security to prevent opening of a door as by kicking or striking the door because the door jamb is relatively easily broken since the strike plate is generally attached near the edge of the wooden structure.

Typical apparatus devised heretofore to provide improved connector apparatus for strike plates is disclosed in the following United States Patents:

U.S. Pat. No. 1,618,846; U.S. Pat. No. 2,370,781; U.S. Pat. No. 2,650,848; U.S. Pat. No. 3,806,176; U.S. Pat. No. 3,888,530; U.S. Pat. No. 4,005,890; U.S. Pat. No. 4,074,484; U.S. Pat. No. 4,105,235.

Prior art patents disclose various types of lock guards and connectors driven into the wooden door jamb to provide structural reinforcing.

However, support structure for strike plates to provide security has generally required extensive modification of the strike plate itself and was not particularly adapted for installation in existing structures to provide an increased security.

SUMMARY OF INVENTION

The strike plate support described herein and illustrated in the attached drawings includes a generally L-shaped connector member having a pair of legs which are offset such that a first leg is positioned in a plane which is spaced from and parallel to a plane in which the second leg is positioned. The first leg can be positioned to engage the lug or tang on a conventional strike plate while the second leg is positionable through an aperture in a door jamb and can be secured in position by a nut or other anchor means for securely attaching the support plate to the door jamb. A rod is connected by a hinge pin to the outer extremity of the first leg on the opposite side of the tang on the strike plate from the second leg of the connector. The opposite end of the rod is secured by suitable anchor means such as a threaded nut to the door jamb to provide a strong rigid strike plate support apparatus which can be mounted in existing door frame structures with a minimum of modification.

A second embodiment of the apparatus includes a pair of rods secured to the first leg of the connector member at spaced locations along the length thereof to accommodate a pair of strike plates for doors equipped with two locks, for example, one lock being equipped with a door knob and the other being a dead bolt lock.

A primary object of the invention is to provide a strike plate support which can be employed in combination with a conventional strike plate and positionable in a door jamb to prevent tearing the strike plate from the wooden door jamb by application of force against the door.

Another object of the invention is to provide a strike plate support of segmented construction such that the connector member can be modified readily on the job site to accommodate strike plates of various shapes and configurations.

A further object of the invention is to provide a strike plate support which can be mounted in existing door jambs after a door has been hung without substantial modification or replacement of the door jamb construction.

Other and further objects will become apparent upon referring to the detailed description hereinafter following and to the drawings annexed hereto.

DESCRIPTION OF THE DRAWING

Drawings of two preferred embodiments of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
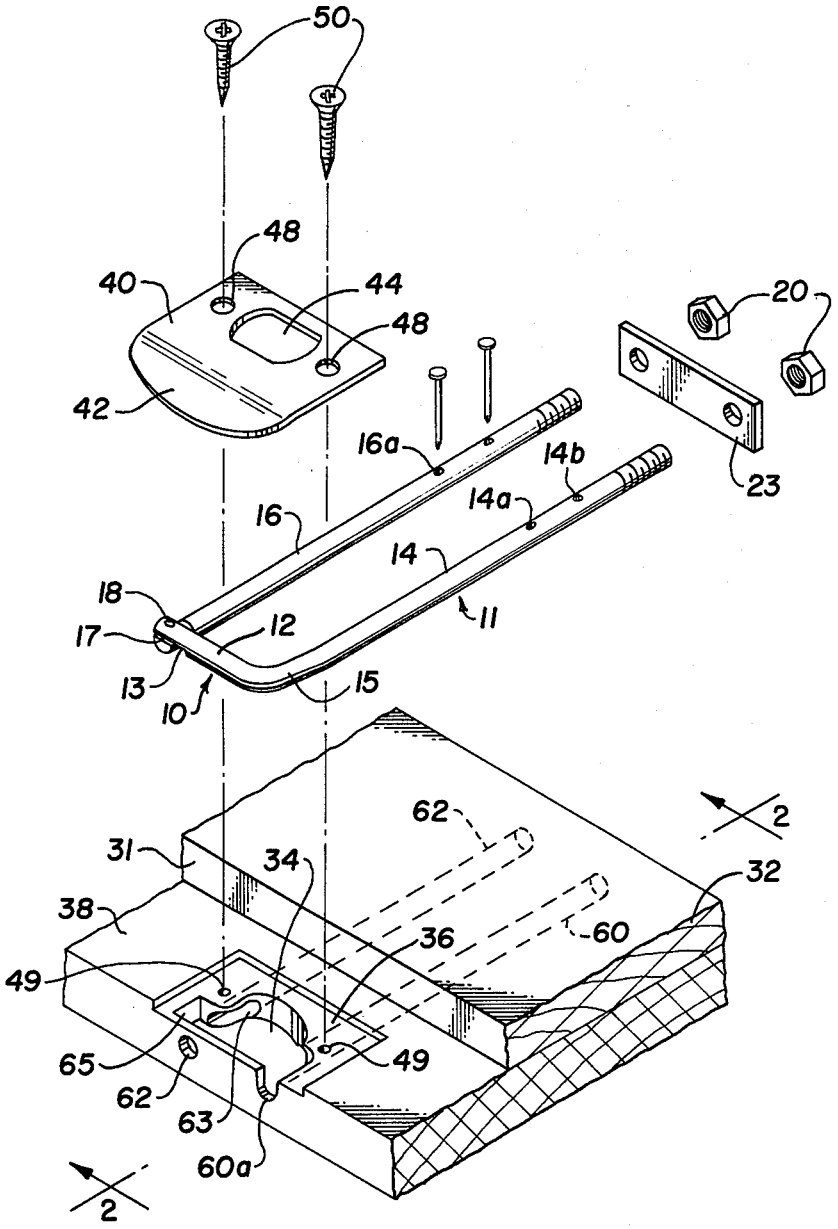
FIG. 1 is an exploded perspective view of the strike plate support illustrating its relationship to a door jamb and a strike plate.

Referring to FIG. 1 of the drawing, the numeral 10 generally designates the strike plate support comprising a generally L-shaped connector member 11 having a pair of generally perpendicularly extending legs 12 and 14. As will be hereinafter more fully explained, a rod 16 is secured to the outer extremity of the first leg 12 of the connector member to form a generally U-shaped support which can be mounted in a door jamb 30 for supporting a strike plate 40.

The door jamb 30 is generally constructed of wood or other suitable material and is provided with a door stop 32 which may be either an integral unit or a separate piece secured thereto by nails or screws. When the door is closed, an edge of the door engages face 31 of door stop 32 to limit movement of the door.

Strike plate 40 is of conventional design and generally comprises a body portion 40 having a curved lip 42 formed on the outer edge thereof to urge a spring loaded lock bolt to a retracted position in the door until the bolt is aligned with a central bolt receiving passage 44 in the strike plate. Strike plates generally have a deflected tang 46 adjacent the front edge of bolt receiving passage 44 to provide a wear surface and to provide structural reinforcing for the attachment of the strike plate 40 to a door jamb 30. Strike plate 40 is secured to door jamb 30 by a pair of screws 50 which extend through apertures 48 in strike plate 40 and into holes 49 in door jamb 30.

For mounting strike plate 40 in the door jamb 30 the strike plate is first positioned in conventional manner, usually by using a template for locating the position of the strike plate on the door jamb. A hole 34 is then drilled into the door jamb to form an opening into which the latch bolt will extend and aligned with the bolt receiving passage 44 in strike plate 40. After the shape of the strike plate has been marked on the door jamb a portion of the door jamb 30 is chiseled out to form a mortis 36 to permit positioning strike plate 40 such that the outer surface thereof will be substantially aligned with and in the same plane as the surface 38 on the door jamb.

At this point, screws 50 would normally be positioned through apertures 48 in the strike plate 40 and screwed into holes 49 in the door jamb 30 for completing the installation of the strike plate 40. However, prior to attaching strike plate 40 to the door jamb 30, or after removing strike plate 40 from the door jamb 30, the strike plate support 10 should be installed. This is accomplished by drilling holes 60 and 62 into the door jamb into which leg 14 of connector 11 and rod 16 will extend as illustrated in FIGS. 1 and 2 of the drawing.

After holes 60 and 62 have been drilled into the jamb 30 a groove 65 is formed for receiving the first leg 12 of connector 11.

Figure 2:
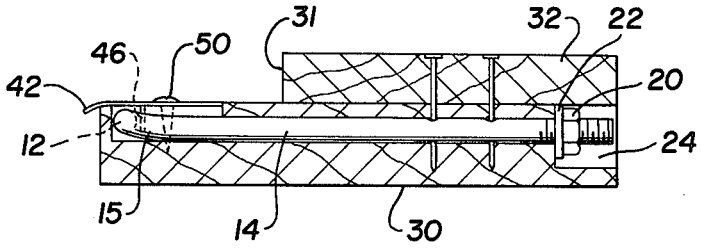
FIG. 2 is a cross-sectional view taken substantially along line 2—2 of FIG. 1 with the strike plate and strike plate support in position.

As best illustrated in FIG. 2 of the drawing, the first leg 12 extends generally perpendicular to the first leg 14 of connector 11 and is positioned to engage tang 46 on strike plate 40 when positioned parallel to the plane of the body portion 41 of the strike plate. A portion 15 of the second leg 14 is deflected downwardly as illustrated in FIG. 2 and extends from the first leg 12 in a direction generally away from the plane of strike plate 40 to position the second leg 14 in a plane spaced from and parallel to the plane in which leg 12 lies.

Thus, when leg 12 is positioned to engage the lower surface of strike plate 40 and to engage tang 46, portion 15 of the connector causes the second leg 14 is be positioned below the outer surface of jamb 30 and embedded therein.

The outer extremity of leg 14 is preferably adapted for anchoring leg 14 in the door jamb 30. In the illustrated embodiment leg 14 is provided with threads to receive an internally threaded nut and a washer 22 which are received in a counterbore 24 formed in door jamb 30. After nut 20 and washers 22, or plate 23, have been attached to the ends of leg 14 and rod 16, it should be readily apparent that any force applied to strike plate 40 in a direction parallel to the plane of strike plate 40 and directed away from face 31 of stop 32 will be applied to the first leg 12 of connector 11 which has opposite ends restrained by leg 14 and rod 16. Thus, force applied to the strike plate 40 will apply compressive force to the door jamb 30 to prevent movement of strike plate 40.

Referring to FIG. 1 of the drawing, a flattened portion 13 is formed on the outer extremity of the first leg 12 of connector 11 and a flattened portion 17 is formed on the end of rod 16. Aligned apertures are drilled through the flattened portions 13 and 17 and a hinge pin 18 is positioned therethrough for connecting the end of rod 16 to the end of leg 12.

It should be readily apparent that leg 14 is positionable in aperture 30 while leg 20 is positioned substantially perpendicular to surface 38. After leg 12 moves through the U-shaped end **60*a* of opening 60 it can be rotated downwardly into groove 65 for positioning the flat portion 13 in engagement with the flat portion 17 on rod 16 which has been previously positioned in hole 62. Hinge pin 19 is then positioned for connecting the connector member 11 and rod 16 to prevent removal thereof. At this point, nuts 20 will be attached to the threaded ends of leg 14 and rod 16**.

After connector member 10 has been positioned as hereinbefore described, strike plate 40 is positioned in the mortis 36 such that tang 46 engages leg 12 of the connector member 10. Screws 50 are then secured in holes 49 in the door jamb 30 for completing the construction.

Figure 3:
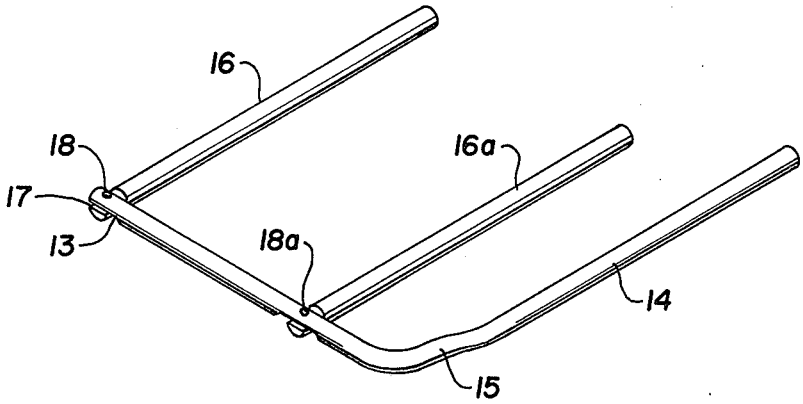
FIG. 3 is a perspective view of a second embodiment of the strike plate support particularly adapted for supporting a pair of strike plates.

The second embodiment, illustrated in FIG. 3, is substantially the same as that illustrated in FIG. 1, except that the first leg 12 is sufficiently long to accommodate two strike plates. Further, a second rod **16*a* is secured to leg 12 by a pin 18*a* extending through apertures in the end of rod 16*a* and in a portion of leg 12** intermediate opposite ends thereof.

Further, spaced apertures **14*a* and 14*b* are formed in leg 14 to receive nails which may be driven through door stop 32 into jamb 30 to anchor leg 14 against longitudinal movement. Rod 16 is similarly provided with spaced apertures 16*a* and 16*b***.

From the foregoing, it should be apparent that the strike plate support described herein accomplishes the objects of the invention. When installed, the support 10 securely supports the strike plate against movement which could damage the door jamb.

Further, the only visual change in the installation is holes **60*a* and 62 which extend through the edge of the door jamb. The mortis in the rear edge of the door jamb in which plate 23 and nuts 20** are installed will normally be covered by a door facing.

Having described my invention, I claim:

1. Apparatus for securing a strike plate having a deflected tang portion extending outwardly from the plane of the body portion of the plate to a door jamb comprising: a generally L-shaped connector member having a pair of generally perpendicularly extending legs, a first of said legs being arranged to engage the tang on the strike plate when positioned parallel to the plane of the body of the strike plate, a portion of the second leg being deflected to extend away from the plane of the body of the strike plate to position the second leg in a plane spaced from the plane of the first leg; a rod; means securing said rod to the outer extremity of the first leg such that the rod and the second leg on said connector member lie in a common plane; and anchor means on said rod and on said second leg for attachment to a door jamb.

2. Apparatus for securing a strike plate to a door jamb according to claim 1, said means securing said rod to the outer extremity of the first leg comprising: a hinge pin extending through aligned apertures in the extremity of the first leg and the end of said rod.

3. Apparatus for securing a strike plate to a door jamb according to claim 1, said second leg and said rod having threads formed thereon; and said anchor means comprising: threaded nuts secured to ends of said second leg and said rod.

4. Apparatus for securing a strike plate to a door jamb according to claim 1, with the addition of a second rod secured to said first leg intermediate opposite ends thereof.

5. A door jamb having a door stop thereon and a strike plate attached thereto, the improvement comprising: a generally L-shaped connector member having a pair of legs and a deflected portion for positioning said first and second legs in spaced parallel planes; a rod; means pivotally securing one end of said rod to an extremity of one of said legs of said connector member; and anchor means securing said connector member and said rod to the door jamb such that the connector member engages the strike plate to prevent movement of the strike plate in a plane parallel to the body of the strike plate.

* * * * *